United States Patent [19]

Wehrli

[11] Patent Number: 4,997,496

[45] Date of Patent: Mar. 5, 1991

[54] EXPLOSIVE AND PROPELLANT COMPOSITION AND METHOD

[75] Inventor: Pius A. Wehrli, North Caldwell, N.J.

[73] Assignee: Hoffmann-La Roche Inc., Nutley, N.J.

[21] Appl. No.: 365,346

[22] Filed: Jun. 13, 1989

[51] Int. Cl.[5] ..... C06B 45/06

[52] U.S. Cl. ..... 149/18; 149/19.7; 149/21; 149/19.92; 149/61; 149/110; 149/112

[58] Field of Search ..... 149/18, 19.7, 19.92, 149/61, 110, 112, 21, 109.6

[56] References Cited

U.S. PATENT DOCUMENTS

| | | | |
|---|---|---|---|
| 907,007 | 12/1908 | Ceipek | 149/46 |
| 1,056,365 | 3/1913 | Raschig | 149/109.4 |
| 1,128,380 | 2/1915 | Sparre | 149/43 |
| 2,566,602 | 9/1947 | Simo | 52/17 |
| 2,655,694 | 10/1953 | Piper | 264/3.3 |
| 3,296,044 | 1/1967 | Genrig | 149/47 |
| 3,361,604 | 1/1968 | Griffith | 149/44 |
| 3,396,637 | 8/1968 | Bobinski et al. | 102/38 |
| 3,409,708 | 11/1968 | Moore | 264/3.4 |
| 3,485,686 | 12/1969 | Jessop et al. | 149/41 |
| 3,557,700 | 1/1971 | Quinlan et al. | 102/38 |
| 3,670,649 | 6/1972 | Hartlein et al. | 102/38 |
| 3,725,516 | 1/1973 | Kaufman | 264/3 B |
| 3,730,094 | 5/1973 | Quinlan | 102/38 |
| 3,737,350 | 6/1973 | Grant | 149/17 |
| 3,783,735 | 1/1974 | Murphy | 86/20.12 |
| 3,816,191 | 6/1974 | Wilson et al. | 149/41 |
| 3,862,866 | 1/1975 | Timmerman et al. | 149/21 |
| 3,901,153 | 8/1975 | Brabets et al. | 102/38 |
| 3,908,509 | 9/1975 | Kelly et al. | 86/1 R |
| 3,910,805 | 10/1975 | Catanzarite | 149/83 |
| 3,919,940 | 11/1975 | Ploger et al. | 102/24 R |
| 3,925,122 | 12/1975 | Berthmann et al. | 149/2 |
| 3,944,235 | 11/1976 | Politzer et al. | 102/101 |
| 3,964,255 | 6/1976 | Catanzarite | 149/77 |
| 3,971,729 | 7/1976 | Timmerman | 252/187 R |
| 3,987,731 | 10/1976 | Brzuskiewicz | 102/43 R |
| 4,025,591 | 5/1977 | Pendergast | 264/3 R |
| 4,051,207 | 9/1977 | Brachert et al. | 264/3 B |
| 4,068,589 | 1/1978 | Oversohl | 102/43 R |
| 4,080,411 | 3/1978 | Stanley | 264/3 B |
| 4,111,727 | 9/1978 | Clay | 149/2 |
| 4,128,443 | 12/1978 | Pawlak et al. | 149/71 |
| 4,137,286 | 1/1979 | Bornstein | 264/3 R |
| 4,140,562 | 2/1979 | Gualillo et al. | 149/19.1 |
| 4,179,404 | 12/1979 | Barone | 252/435 |
| 4,335,063 | 6/1982 | Kolb et al. | 264/3 B |
| 4,356,769 | 11/1982 | Galluzzi | 102/380 |
| 4,394,198 | 7/1983 | Takeuchi et al. | 149/21 |
| 4,427,465 | 1/1984 | Gonzalez | 149/2 |
| 4,497,676 | 2/1985 | Kurtz | 149/2 |
| 4,728,376 | 3/1988 | Kurtz . | |

FOREIGN PATENT DOCUMENTS

| | | |
|---|---|---|
| 2022468 | 7/1970 | France . |
| 4509 | of 1896 | United Kingdom . |
| 9111 | of 1897 | United Kingdom . |
| 796154 | 6/1958 | United Kingdom . |

OTHER PUBLICATIONS

Rocket Propellant Handbook, Kit and Evered, The Mac Millan Company, pp. 148–151 (1060).

*Primary Examiner*—Stephen J. Lechert, Jr.
*Attorney, Agent, or Firm*—George M. Gould; Bernard S. Leon; Alan P. Kass

[57] ABSTRACT

An explosive and propellant composition is obtained by admixing finely divided particles of ascorbic acid and a nitrate-containing oxidation agent, such as potassium nitrate. Admixing can be carried out in the dry state, at room temperature. The composition upon ignition gives off no sulfurous fumes, and leaves little or no carbon residue; and causes no corrosion with contacted metal surfaces.

24 Claims, No Drawings

EXPLOSIVE AND PROPELLANT COMPOSITION AND METHOD

BACKGROUND OF THE INVENTION

1. Field of the Invention

This invention relates to explosive and propellant compositions based on mixtures of organic acids or derivatives and nitrate-containing oxidizers.

2. State of the Art

It has been known to practitioners in the art of explosives and munitions that compositions having explosive or propellant properties can be prepared from organic or inorganic nitrates. For instance, conventional gunpowder also referred to as black powder, is typically composed of sulfur, potassium nitrate and charcoal. Other combustible compositions which are utilizable as ammunition, explosives or propellants also contain nitrates as the oxidizer portion of the composite blend. Usually, ammonium nitrate or alkali metal nitrates are employed as preferred oxidizers in many such applications.

A significant advance in this art is disclosed in U.S. Pat. No. 4,497,676 (Kurtz). The patent describes the discovery that an aqueous slurry of an organic acid, such as ascorbic or erythorbic acid, and an inorganic nitrate, such as potassium nitrate, when heated to drive off the water, produces a composite material which is useful as an explosive and propellant. The material is comparable in performance to black powder ballistically, but is safer to handle and burns cleaner, giving off no sulfurous fumes and leaving no corrosive residue.

U.S. Pat. No. 4,728,376 (Kurtz) describes an improvement in such a composition, in which the mixture is heated at certain elevated temperatures during processing to produce a clearly identifiable reaction which results in a chemical and/or physical change in the organic acid portion, e.g., the ascorbic or erythorbic acid.

European Patent Publication No. 268996 describes explosive materials obtained by mixing a degradation product of ascorbic acid or erythorbic acid with a nitrate-containing oxidation agent.

SUMMARY OF THE INVENTION

The present invention is based on the discovery that mixtures of ascorbic acid and a nitrate-containing oxidation agent (or "oxidizer") provide a novel composition which is useful, as a dry powder or in a compressed shape, in various explosive or propellant applications.

The composite blend of this invention offers the advantages of simplicity and greater safety in its mode of preparation. Unlike certain previous explosive-propellant mixtures, the present composition is prepared without degrading the ascorbic acid. Mixing and blending of the ingredients at room temperature, without any degradation or pre-degradation step, produces a consumable material which upon ignition burns cleanly, emits no sulfurous fumes, leaves little or no carbon residue, and is non-corrosive to contacting metal surfaces. Further, the composition has less tendency to absorb moisture upon standing and can be stored for extended periods without the necessity for the extraordinary precautions a more hygroscopic material would require.

Briefly, the invention in its various facets comprises an explosive and propellant composition, a method of making the composition, and a consumable cartridge which utilizes the composition as the propellant charge, now to be described in greater detail below.

DETAILED DESCRIPTION OF THE INVENTION

Before use in preparing the composition of this invention, the ingredients may be ground or otherwise reduced in size from the particle size of the powder or crystals sold commercially. Experience has shown that smaller particle sizes for the ascorbic acid and nitrate-containing oxidizer often result in better ballistic performance, with particle sizes of 10 microns or less being preferred. Comminution of the particles may be accomplished by mechanical milling. Alternatively, the ingredients may be dissolved individually in an aqueous or organic liquid medium and precipitated from the medium in the form of more finely divided particles.

In one procedure which is applicable to this invention, potassium nitrate crystals of greater than 10 microns in size are dissolved in water at temperatures of 60°-65° C., and the aqueous solution is poured quickly into vigorously stirred acetone cooled to 0°-10° C., resulting in the precipitation of particles of potassium nitrate of 10 microns or less, which are then filtered, washed and dried.

The relative proportions of the ascorbic acid and nitrate-containing oxidation agent can vary widely in the composition, depending on specific applications and particular requirements for such applications. In general, the weight ratio of the ascorbic acid to nitrate-containing oxidation agent will vary between 10:90 and 50:50, and more usually between 20:80 and 45:55.

For ballistic applications especially, it has been found that best results are achieved when the ascorbic acid and nitrate-containing oxidizer are utilized in amounts which are stoichiometrically balanced, or nearly so. For such applications, an especially suitably composition will comprise from about 30 to about 45 grams of ascorbic acid and from about 70 to about 55 grams of potassium nitrate, for each 100 grams of the two ingredients combined.

As the nitrate-containing oxidizer it is preferred to use an alkali or alkaline earth metal nitrate or ammonium nitrate These nitrates can be employed individually or in various combinations. Potassium nitrate is most preferred. Other oxidizing agents such as potassium chlorate and ammonium and potassium perchlorate can also be utilized.

Organic nitrates can also be used as the nitrate-containing oxidation agent. The term "organic nitrate" is intended to refer to any carbon-containing nitrate having a stoichiometric excess of oxygen and which is suitable for use in pyrotechnic, explosive or propellant formulations. Such materials include nitrocellulose, nitroglycerine and pentaerythritol nitrate, as well as other organic nitrate esters conventionally used as liquid plasticizers for explosive materials and rocket fuels.

To obtain formulations which are compressible into self-sustaining shapes such as rods, cones, pellets, or the like, it is necessary to add a material which functions as a binder for the ascorbic acid and nitrate-containing oxidizer. Preferred for this purpose is vegetable starch, especially corn starch, or ethyl cellulose. The binder material is added in an amount sufficient to impart a self-sustaining shape to the composition when compressed, usually 1 to 5 percent by weight.

If desired, further additives can be included in the composition, for example, coloring agents, gelatinizing agents or stabilizers such as ureas, e.g., Akardit® or Centralit®, substituted urethanes, phthalates, polymers, additives for illuminating compositions such as sodium, barium, strontium or copper salts, or additives for enhancing the explosive energy or improving other desirable properties, for example, boron or nitroguanidine.

The composition of the invention is prepared conveniently by forming an admixture of the ascorbic acid and nitrate-containing oxidizer in particulate form, alone or together with any additional ingredients to be included in the formulation. The preparation can be carried out by blending the ingredients in the dry state at room temperature for a sufficient length of time to form a homogeneous mixture. Alternatively, the ascorbic acid and nitrate-containing oxidizer can be dissolved or suspended in water, or an organic solvent, or mixture of both mixed thoroughly, then collected in a conventional manner by precipitation, filtration, evaporation, etc.

These procedures will typically result in a free flowing powder. For certain applications, it may be desirable or necessary to granulate the powder. This can be done in a conventional manner, for instance, by compacting the powder into rods or tablets with a suitable binder material having been added, comminuting the compacted powder into particles, and fractioning to obtain the desired sizes.

As mentioned, the composition of the invention is useful for a variety of explosive and propellant applications. To indicate just a few specific applications, the product can be utilized for the manufacture of artillery shells or rifle cartridges, for illuminating or signal munitions, for rockets, blasting devices and fireworks.

The composition can, for instance, be employed as the powder changes in an antique firearm or as the explosive propellant in a consumable firearm cartridge comprising a priming means, a projectile means and a molded cartridge case containing the explosive composition.

The following Examples illustrate preferred embodiments of the invention and methods of their preparation, without any intention to be limiting.

EXAMPLE 1

380 grams of ascorbic acid (USP grade) and 620 grams of crystalline potassium nitrate were milled in a ceramic ball mill at room temperature for 28½ hours. A fine white powder was obtained.

A portion of the powder was evaluated for burning characteristics. Upon ignition, the sample flash-burned and left little residue.

A sample of approximately 16 grams of the powder was placed in a dessicator and exposed to an open tray of water within the dessicator. After 24 hours, the 16-gram sample had absorbed only 0.23 grams of water (about 1.4%). When removed from the dessicator and exposed to the atmosphere, the sample reverted to its original weight after 6 hours. It was concluded that the material is not hygroscopic; the slight increase in weight when stored in the dessicator was attributable to surface moisture only.

EXAMPLE 2

This Example illustrates the preparation and use of a compactible explosive-propellant composition in accordance with this invention.

200.6 grams of ascorbic acid (ultra fine powder, USP grade), 327.4 grams of potassium nitrate (sievable through 230 on 325 mesh, U.S. Standard Sieve), and 22 grams of corn starch (STA-RX 1500, A.H. Staley Company) were mixed well by shaking in a closed container for approximately 15 minutes. The resulting mixture was compressed into rods of about ¾ inches in diameter, having a weight of 5–10 grams each, using a Carver press and an applied pressure of ten tons. The rods were broken up into smaller chunks, then crushed into granules and sieved into fractions. Three fractions of approximately one hundred grams each were obtained, having the following mesh sizes:

(A) through 20 on 30
(B) through 30 on 40
(C) through 40 on 60

The product exhibited good ballistic properties upon testing with 60-grain loads, with velocities of about 1200 feet per second or higher and chamber pressures of greater than 4000 lead units of pressure (L.U.P.) being obtained.

EXAMPLE 3

This Example illustrates two different methods by which a composition in accordance with the invention was prepared to obtain end products with different physical properties.

185 grams of ascorbic acid (ultra fine powder, USP grade), 310 grams of potassium nitrate (precipitated and sieved through 325 mesh screen, particle size approximately 10 microns), and 5 grams of corn starch (STA-RX 1500, A.H. Staley Co.) were mixed thoroughly for 30 minutes in a three-liter flask equipped with a Teflon paddle stirrer. The procedure was repeated to give a second batch of an identical amount of the material. The first batch was utilized in a dry compacting process and the second batch was utilized in a wet extrusion process, as follows:

A. Dry Compaction Process

The mixed material prepared as described above was compressed into tablets using a one-inch die and an applied pressure of 20,000 pounds. The tablets were crushed and sieved into the three fractions shown in the Table below.

B. Wet Extrusion Process 204 milliliters of ethanol (90%) was added to 500 grams of the mixed material prepared as described above and the material was worked into a "dough ball", extruded through a 20 mesh sieve, then dried at 100° C. for one hour. The dried material was crushed and sieved into three fractions as shown in the Table.

The respective materials were evaluated for bulk density, burn rate, gas generation, and ballistic performance. The burn rate, gas generation and ballistic performance were measured as follows:

Burn Rate

A two-foot aluminum ruler with a groove ⅛ inch wide and the same depth was constructed. The groove was filled with test material having a defined mesh size and weight. Ignition at one end allowed measurement of the time it took to burn two feet, using a stop watch.

Gas Generation

Pellets of test material were formed by compression in a Carver press at 10,000 lbs. for five minutes. The pellets were ignited individually by a Bunsen burner in a 100 ml. Hoke bomb. Ignition was observed on the attached manometer by the sudden surge of pressure to approximately 400 lbs. After cooling the bomb to room temperature under running water, followed by five minutes in a water bath at 20° C., the gas volume was measured using toluene displacement.

Ballistic Performance

All firings were done using a 32-inch rifled, .45 caliber muzzle loading pressure test barrel on an indoor range at ambient conditions. Projectibles were Hornady #6060 round balls 0.451 inch diameter, weighing 138.0 grains. Connecticut Bally Arms #11 percussion caps were used. Balls were seated with lubricated cotton patches.

TABLE

Comparison of Dry and Wet Methods

| Sample | Mesh Size | Bulk Density, g/mL | Charge, in grams | Burn Rate, sec/2 ft. | Gas Generation, mL/g | Ballistic Performance ft./sec |
|---|---|---|---|---|---|---|
| (A) (1) | 20/30 | 0.761 | 6.21 | 1.68 | 278 | 1099 |
| (A) (2) | 30/40 | 0.732 | ND | ND | ND | 1110 |
| (A) (3) | 40/60 | 0.725 | ND | ND | ND | 1445 |
| (B) (1) | 20/30 | 0.534 | 4.27 | 1.97 | 313 | 1214 |
| (B) (2) | 30/40 | 0.522 | ND | ND | ND | 1435 |
| (B) (3) | 40/60 | 0.508 | ND | ND | ND | 1282 |

ND = Not determined

I claim:

1. An explosive and propellant composition which comprises an admixture of ascorbic acid having a particle size of about 10 microns or less and a nitrate-containing oxidation agent having a particle size of about 10 microns or less.

2. A composition according to claim 1, in which the weight ratio of ascorbic acid to nitrate-containing oxidation agent is between 10:90 and 50:50.

3. A composition according to claim 2, in which the weight ratio of ascorbic acid to nitrate-containing oxidation agent is between 20:80 and 45:55.

4. A composition according to claim 1, in which the nitrate-containing oxidation agent is an inorganic nitrate.

5. A composition according to claim 4, in which the inorganic nitrate-containing oxidation agent is an alkali or alkaline earth metal nitrate.

6. A composition according to claim 5, in which the alkali metal nitrate oxidation agent is potassium nitrate.

7. A composition according to claim 1, which further comprises an additive selected from the group consisting of binder materials, coloring agents, gelatinizing agents, illuminating agents, and explosive enhancing agents.

8. A composition according to claim 7, wherein said binder material is present in an account sufficient to enable the composition to substain its shape when compressed.

9. A composition according to claim 8, in which the binder material is starch.

10. A method of making an explosive and propellant composition of ascorbic acid having a particle size of about 10 microns or less and a nitrate-containing oxidation agent having a particle size of about 10 microns or less, comprising forming a homogeneous admixture of the two ingredients in particulate form.

11. A method according to claim 10, in which the ascorbic acid and nitrate-containing oxidation agent are employed in a weight ratio between 10:90 and 50:50.

12. A method according to claim 11 in which the ascorbic acid and nitrate-containing oxidation agent are employed in a weight ratio between 20:80 and 45:55.

13. A method according to claim 10, in which the nitrate-containing oxidation agent is an inorganic nitrate.

14. A method according to claim 10, in which the inorganic nitrate-containing oxidation agent is an alkali or alkaline earth metal nitrate.

15. A method according to claim 14, in which the alkali metal nitrate oxidation agent is potassium nitrate.

16. A method according to claim 10, which further comprises an additive selected from the group consisting of binder material, coloring agents, gelatenizing agents, illuminating agents, and explosive enhancing agents.

17. A method according to claim 16, wherein said binder material is present in an amount sufficient to enable the composition to substain its shape when compressed.

18. A method according to claim 10, in which the binder material is corn starch.

19. A method according to claim 10, in which the ascorbic acid and nitrate-containing oxidation agent comprise particles of about 10 microns or less.

20. A method according to claim 10 in which the ingredients are dry blended at room temperature.

21. A method according to claim 10 in which the ingredients are blended in an aqueous or organic liquid medium.

22. A consumable cartridge comprising:

(a) priming means;

(b) projectile means; and (c) molded cartridge case containing said projectile for use in a firearm, the molded cartridge case containing an explosive and propellant composition of ascorbic acid having a particle size of about 10 microns or less and a nitrate-containing oxidation agent having a particle size of about 10 microns or less.

23. A consumable cartridge according to claim 22, in which the nitrate-containing oxidation agent is an alkali metal nitrate.

24. A consumable cartridge according to claim 23, in which the alkali metal nitrate is potassium nitrate.

* * * * *